US008506019B2

(12) United States Patent
Monyak et al.

(10) Patent No.: US 8,506,019 B2
(45) Date of Patent: Aug. 13, 2013

(54) BLOCK AND SLEEVE WITH ROTATION-INHIBITING FEATURE

(75) Inventors: Kenneth Monyak, Abingdon, VA (US); Joseph Fader, Abingdon, VA (US)

(73) Assignee: Sandvik Intellectual Property AB, Sandviken (SE)

( * ) Notice: Subject to any disclaimer, the term of this patent is extended or adjusted under 35 U.S.C. 154(b) by 263 days.

(21) Appl. No.: 12/991,066

(22) PCT Filed: Apr. 9, 2009

(86) PCT No.: PCT/SE2009/050376

§ 371 (c)(1),
(2), (4) Date: Jan. 24, 2011

(87) PCT Pub. No.: WO2009/139691

PCT Pub. Date: Nov. 19, 2009

(65) Prior Publication Data

US 2011/0109147 A1 May 12, 2011

Related U.S. Application Data

(60) Provisional application No. 61/053,268, filed on May 15, 2008.

(51) Int. Cl.
*E21C 35/197* (2006.01)

(52) U.S. Cl.
USPC ..... 299/104; 299/106

(58) Field of Classification Search
USPC ..... 299/104, 106
See application file for complete search history.

(56) References Cited

U.S. PATENT DOCUMENTS

| | | | | |
|---|---|---|---|---|
| 4,333,687 | A * | 6/1982 | Barnstorf | 299/81.2 |
| 5,106,166 | A * | 4/1992 | O'Neill | 299/104 |
| 5,931,542 | A | 8/1999 | Britzke et al. | |
| 6,113,195 | A | 9/2000 | Mercier et al. | |
| 6,176,552 | B1 * | 1/2001 | Topka et al. | 299/104 |
| 2003/0015907 | A1 * | 1/2003 | Sollami | 299/104 |
| 2012/0104833 | A1 * | 5/2012 | Latham | 299/104 |

FOREIGN PATENT DOCUMENTS

| | | |
|---|---|---|
| GB | 2 247 705 | 3/1992 |

* cited by examiner

*Primary Examiner* — David Bagnell
*Assistant Examiner* — Michael Goodwin
(74) *Attorney, Agent, or Firm* — Morgan, Lewis & Bockius LLP

(57) ABSTRACT

A block and sleeve assembly is disclosed including a holder block, and a hollow sleeve. In radial cross-section, outer peripheral edges of the shoulder portion of the sleeve have a shape of a first polygon. The holder block and the hollow sleeve include cooperating rotation inhibiting features. For example, the holder block includes a stop projecting forwardly past a plane of the front face and positioned radially offset from a circumference of the opening in the holder block to allow a rearward surface of the shoulder portion of the sleeve to contact the front face of the holder block and to prevent rotation of the hollow sleeve greater than N degrees, $$N = \frac{360}{n},$$

where n is the number of sides of the first polygon, by contacting an outer peripheral edge of the shoulder portion with the stop. A sleeve per se and an assembly including a cutting pick are also disclosed.

19 Claims, 3 Drawing Sheets

BLOCK AND SLEEVE WITH ROTATION-INHIBITING FEATURE

RELATED APPLICATION DATA

This application is a National Stage of International Application No. PCT/SE2009/050376, filed Apr. 9, 2009, and claims priority under 35 U.S.C. §119(e) to U.S. Provisional Application No. 61/053,268 filed May 15, 2008.

FIELD

The present disclosure relates generally to a block and sleeve assembly. More particularly, a block and a sleeve are disclosed that when assembled together forms a block and sleeve assembly where cooperating features on the sleeve and on the block inhibit or prevent rotation of the sleeve in the bore of the block. The disclosure also relates to a sleeve per se that is shaped to inhibit rotation and, optionally, is shaped to aid in removal of a cutting pick installed in the block and sleeve assembly.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Various different forms of equipment and machinery can be employed for mining and excavation operations. Typically, it is the type of mining or excavation taking place, and the type of earth being mined or excavated, that dictates the type of equipment and machinery that is appropriate. Commonly, equipment and machinery for such purposes include a cutting pick mounted on a rotating element either directly or via a block or via a block and sleeve assembly. In operation, the cutting picks rotate with the rotating element to impact against and to dislodge or fragment earth from the face being contacted. Cutting picks employed for the above purpose generally have a hard cemented tungsten carbide tip, which is fixed, usually by brazing, to a head of the cutting pick, and a steel shank. Cutting picks of this kind are disclosed in various publications, such as U.S. Pat. No. 6,113,195.

Wear is of concern in such operations. Wear occurs from both relative rotation of elements of the block and sleeve and from face-to-face impact of elements with each other. For example, a cutting pick is generally designed to rotate about its longitudinal axis to more evenly wear the tip, to self-sharpen, and to prolong its service life. At the same time, the cutting pick is forced backwards during operation and has a rearward facing surface of a shoulder that impacts a forward face of the mounting, such as the forward face of the block.

Cutting picks directly mounted in the bore of the block can wear on the block. To minimize adverse wear of the block, a sleeve can be interposed between the cutting pick and the block as a sacrificial part for the wear that occurs as the cutting pick rotates and the faces contact. Although the sacrificial sleeve provides some protection from wear for the block, it is still advantageous to further minimize wear. Therefore, to minimize the wear between the sleeve and block assembly, rotation and/or impact motion between the sleeve and the block should be minimized.

SUMMARY

An exemplary embodiment of a hollow sleeve adapted to be mounted in a holder block and to receive a shank of a cutting pick comprises a shank portion, a head portion, and a shoulder portion, wherein the shank portion, head portion and shoulder portion are arranged longitudinal along a central axis with the shoulder portion separating the shank portion from the head portion, wherein a central bore extends axially and rearwardly from an opening in a forwardmost surface of the head portion, wherein, in radial cross-section, outer peripheral edges of the shoulder portion have a shape of a first polygon.

An exemplary embodiment of a block and sleeve assembly comprises a holder block, and a hollow sleeve, wherein the hollow sleeve includes a body including a shank portion, a head portion, and a shoulder portion, and a central bore extending axially and rearwardly from an opening in a forwardmost surface of the head portion, the central bore to receive a shank of a cutting pick, wherein the shank portion, head portion and shoulder portion are arranged longitudinal along a central axis with the shoulder portion separating the shank portion from the head portion, and wherein, in radial cross-section, outer peripheral edges of the shoulder portion have a shape of a first polygon, wherein the holder block comprises a base portion and a body portion, the body portion including an opening extending longitudinally from a front face to receive the shank portion of the hollow sleeve, and wherein the front face includes a stop projecting forwardly past a plane of the front face, the stop positioned radially offset from a circumference of the opening to allow a rearward surface of the shoulder portion of the hollow sleeve to contact the front face of the holder block and to prevent rotation of the hollow sleeve greater than N degrees, $$N = \frac{360}{n},$$

where n is the number of sides of the first polygon.

An exemplary embodiment of an assembly comprises a holder block, a hollow sleeve, and a cutting pick, wherein the hollow sleeve includes a body including a shank portion, a head portion, and a shoulder portion, and a central bore extending axially and rearwardly from an opening in a forwardmost surface of the head portion, wherein the shank portion, head portion and shoulder portion are arranged longitudinal along a central axis with the shoulder portion separating the shank portion from the head portion, wherein, in radial cross-section, outer peripheral edges of the shoulder portion have a shape of a first polygon, wherein the holder block comprises a base portion and a body portion, the body portion including an opening extending longitudinally from a front face to receive the shank portion of the hollow sleeve, wherein the front face includes a stop projecting forwardly past a plane of the front face, the stop positioned radially offset from the opening to allow a rearward surface of the shoulder portion of the hollow sleeve to contact the front face of the holder block and to prevent rotation of the hollow sleeve greater than N degrees, $$N = \frac{360}{n},$$

where n is the number of sides of the first polygon, and wherein a shank of the cutting pick is inserted into the central bore of the hollow sleeve.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Exemplary embodiments of a block and sleeve assembly disclosed herein include a holder block and a hollow sleeve having cooperating features to inhibit or prevent rotation of the sleeve when installed in the holder block. In general, the shank portion of the hollow sleeve is inserted into an opening in the block with a rearward-facing surface of the shoulder portion of the hollow sleeve contacting a face of the block. In an example of cooperating features, a region of the sleeve, e.g., above the shoulder, is shaped to cooperate with an edge of a stop on the block to inhibit rotation of the sleeve in the block. Inhibiting rotation of the sleeve reduces wear on the contacting faces, shanks and bore of the block and hollow sleeve. A non-rotating sleeve can extend the life of these pieces.

Figure 1:
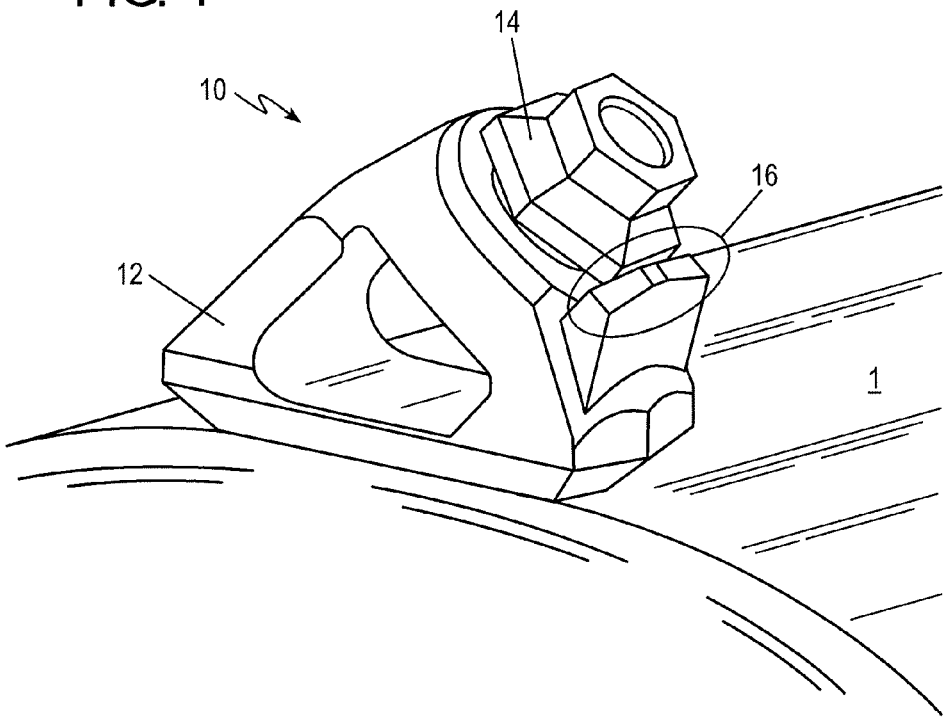
FIG. 1 shows an isometric elevated side view of an exemplary embodiment of a block and sleeve assembly.

FIG. 1 shows an isometric view of an exemplary embodiment of a block and sleeve assembly. The depicted block and sleeve assembly 10 includes a holder block 12 and a hollow sleeve 14. The holder block 12 and the hollow sleeve 14 have cooperating features 16 to inhibit rotation of the sleeve in the block when assembled.

Figure 2:
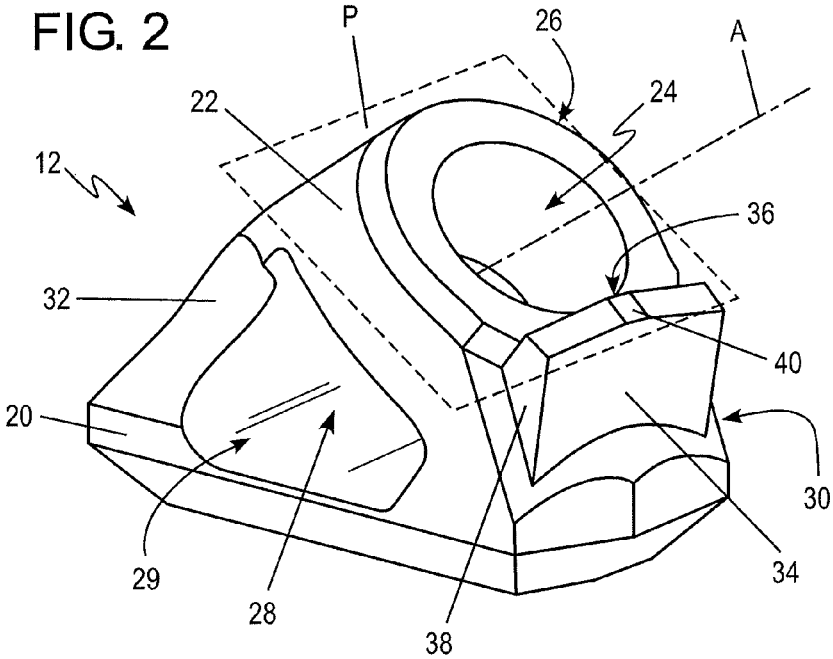
FIG. 2 shows an isometric elevated side view of an exemplary embodiment of a holder block.

An exemplary holder block is shown in FIG. 2. The exemplary holder block 12 comprises a base portion 20 and a body portion 22. The body portion 22 includes an opening 24 extending longitudinally rearward from a front face 26. The opening 24 can extend completely through the body portion 22, or can extend partially through the body portion 22. The base portion 20 of the holder block 12 is adapted for mounting on a rotatable element 1 of a machine for mining, excavating, tunneling, road planing and/or construction (see, FIG. 1), such as an Alpine Miner mining machine available from Sandvik AB. An example of a suitable holder block is a bridged block for mining and trenching cutting systems, which includes an opening 28 extending from a first side edge 29 to a second side edge 30 and forming a bridge portion 32.

The front face 26 of an exemplary holder block 12 includes a stop 34 projecting forwardly past a plane P of the front face 26. Although the cooperating features 16 to inhibit rotation of the sleeve in the block are shown in the figures, in the six-o'clock position relative to the opening in the holder block, the cooperating features 16 can be in any suitable position. According and for example, the stop 34 can project from the front face 26 or can project from a side edge 29,30 or other surface of the holder block 12, as long as the stop 34 projects forwardly past the plane P of the front face 26. Further, the stop 34 is positioned radially offset from the circumference of the opening 24. This provides clearance for portions of the hollow sleeve 14 when inserted into the opening 24 of the holder block 12. In exemplary embodiments, when the hollow sleeve is so inserted, a rearward surface of the shoulder portion of the hollow sleeve contacts the front face of the holder block The stop 34 itself has a surface 36 facing the axis A of the opening 24 that can be planar, circular, angled or other shape, typically a shape that complements the surface that will bear against it, i.e., the shape of the edge of the shoulder portion of the hollow sleeve. Also, the stop 34 can have a large base 38 tapering to a leading edge 40. The leading edge 40 can be linear or have some shape, such as angled from a raised center to assist in the removal of debris during operation. The stop 34 can be welded in place or can be formed integral to the holder block in a forging or machining operation.

Figure 3:
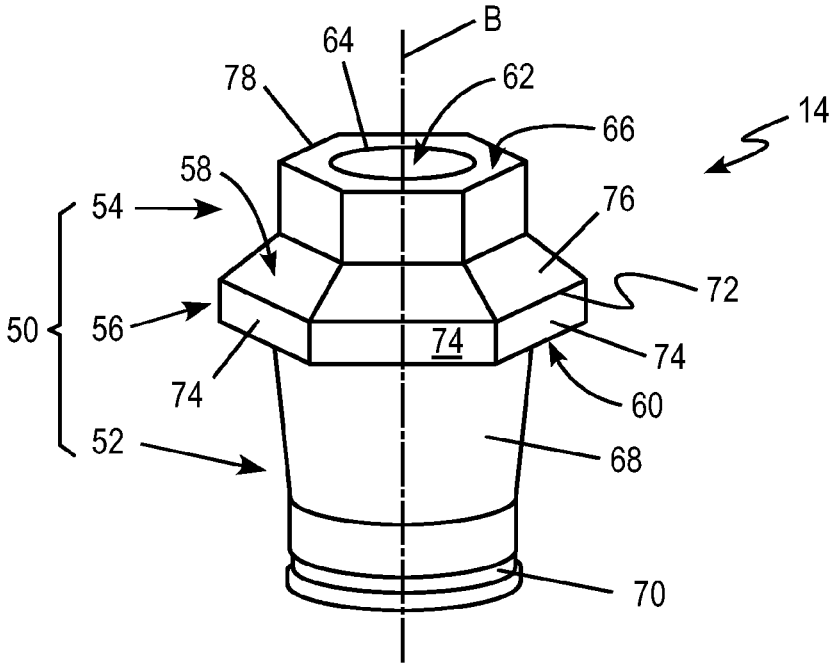
FIG. 3 shows an isometric elevated side view of an exemplary embodiment of a hollow sleeve.

An exemplary hollow sleeve is shown in FIG. 3. The exemplary hollow sleeve 14 comprises a body 50 including a shank portion 52, a head portion 54, and a shoulder portion 56 arranged longitudinally along a central axis B. The shoulder portion 56 generally separates the shank portion 52 from the head portion 54 and includes a radially extending shoulder 58 and rearwardly oriented surface 60. A central bore 62 extends axially and rearwardly from an opening 64 in a forwardmost surface 66 of the head portion 54 and which defines a forwardly oriented face of the hollow sleeve 14. The central bore 62 is adapted to receive a shank of a cutting pick (not shown here).

In general, the shank portion 52 and central bore 62 can be any suitable shank portion or any suitable central bore from a hollow sleeve. In an exemplary embodiment, the shank portion 52 is inserted into the opening 24 of the holder block 12 to mount the hollow sleeve 14 in the holder block 12 of the block and sleeve assembly 10.

Mounting can be by any suitable means. In an exemplary embodiment, mounting is by an interference fit. For example, the hollow sleeve 14 depicted in FIG. 3 has a taper on at least a portion 68 of the shank portion 52 which is oversized relative to the opening 24 in the block holder 12. When inserted into the opening 24, the taper provides an interference fit between the shank portion 52 and the inner diameter surface of the opening 24. In another exemplary embodiment, mounting is by a retaining device, such as a retaining clip, that is inserted into a retainer slot 70. Combinations of mounting methods can also be used.

Figure 4:
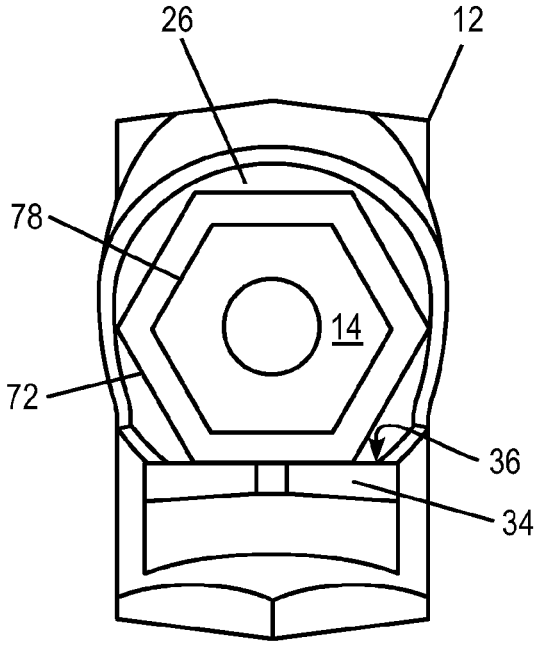
FIG. 4 shows an isometric view of an exemplary embodiment of a block and sleeve assembly seen along the axis of the opening in the block holder.

In an exemplary embodiment, the shoulder portion 56 has a polygonal shape in radial cross-section (shown in FIG. 4 in radial view along the central axis A), although any suitable shape can be used. With a polygonal shape, the shoulder portion 56 has outer peripheral edges 72 that define the shape of the polygon. Any suitable polygonal shape can be used, including polygons with even number of sides, polygons with four sides, five sides, six sides or eight sides. Because the outer peripheral edges 72 have a thickness, each outer face 74 also defines the shape of a second polygon. This second polygon can have the same number of sides as the polygon formed by the outer peripheral edges 72, or it can have a different number of sides. In one example, the second polygon is a quadrilateral. The sloped surfaces 76 can also have a polygonal shape, in this instance a trapezoidal shape.

In an exemplary embodiment, the head portion 54 can optionally have a polygonal shape in radial cross-section (also shown in FIG. 4 in radial view along the central axis A), although any suitable shape can be used. With a polygonal shape, the head portion 54 has outer peripheral edges 78 that define the shape of the polygon. Any suitable polygonal shape can be used, including polygons with even number of sides, polygons with four sides, five sides, six sides or eight sides. This third polygon can have the same number of sides as the first polygon formed by the outer peripheral edges 72, or it can have a different number of sides. In one example, the second polygon is a quadrilateral. In an exemplary embodiment, the outer peripheral edges 78 of the head portion 54 are radially inward from the outer peripheral edges 72 of the shoulder portion 56. The radial relationship of the outer peripheral edges 72, 78 is most readily visible in FIG. 4.

Figure 5A:
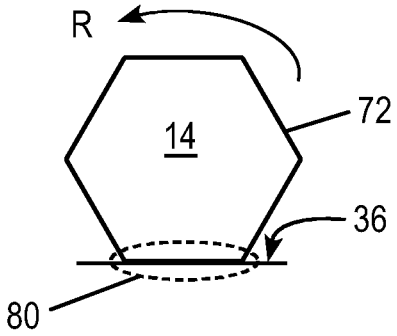
FIGS. 5A and 5B show simplified views of the contact between exemplary embodiments of rotation inhibiting features.
Figure 5B:
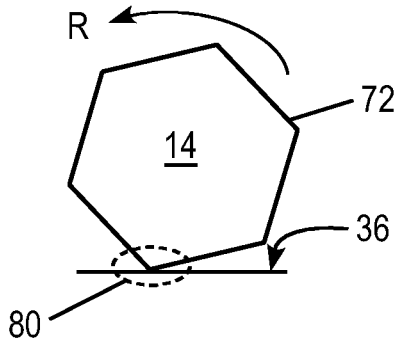

When the hollow sleeve 14 is mounted in the holder block 12, cooperating features 16 on the hollow sleeve 14 and the holder block 12 inhibit or prevent rotation of the sleeve in the bore of the block. In an exemplary embodiment, at least one of the outer peripheral edges 72 cooperates with the stop 34 on the block holder 12 to inhibit or prevent rotation of the hollow sleeve 14 relative to the block holder 12. If rotation is inhibited, then rotation of the hollow sleeve 14 in the bore can only progress so far, i.e., so many degrees, before some part of the peripheral edge 72 contacts the stop 34. Where the radial offset between the peripheral edge 72 and the stop 34 is minimal or, in some cases, even non-existent, the hollow sleeve 14 will only minimally rotate or rotate not at all. In this instance, the contact between the peripheral edge 72 and the stop 34 is a face or plane contact, e.g., outer face 74 contacting surface 36. Of course, manufacturing tolerances may prevent such face or plane contact from occurring while still limiting rotation to less than 10°, alternatively less than 5°, alternatively less than 2°. As the radial offset between the peripheral edge 72 and the stop 34 becomes larger, the hollow sleeve 14 will be free to rotate to a greater extent. In this instance, the contact between the peripheral edge 72 and the stop 34 is a line contact or a point contact (depending on the thickness of the face 74 on the peripheral edge 72). Where the hollow sleeve rotates no more than one face, position-wise, before some contact between cooperating features occurs, then rotation greater than N degrees, $$N = \frac{360}{n},$$

is prevented, where n is the number of sides of the polygonal shape of the outer peripheral edges 72. Alternatively, for an outer peripheral edge with one or more faces 74 being at a larger radial distance from the central axis, rotation is prevented that is greater than or equal to 360°, i.e., the hollow sleeve does not make a complete rotation. In exemplary embodiments, N is 120° or less, alternatively, 90° or less, 60° or less, 45° or less, or 20° less, or in a range between any of these rotation angles. FIGS. 5A and 5B illustrate the rotation R and the contact 80 for the above two instances, with FIG. 5A showing a face or plane contact and FIG. 5B showing a line contact. Of course, the outer peripheral edges 72 and the stop 34 do not have to be straight or planar, but may be concave, convex, angled, partial, continuous or broken, or any other shape, so long as there is portion of the peripheral edge 72 that cooperates with stop 34 and that the hollow sleeve 14 does not make a complete 360° rotation.

The hollow sleeve 14 is adapted to receive a shank of a cutting pick, preferably to rotatably receive a shank of a cutting pick. The cutting pick can be any suitable cutting pick. In an exemplary embodiment, the cutting pick includes a cutting head at a front end with a cutting tip, a shank at a rear end and a shoulder at a transition between the front end and the shank. Where a compression ring or other shank mounted retaining device is used to assist with retaining the cutting pick in the hollow sleeve 14, the inner diameter surface of the hollow sleeve can include a groove to accommodate such compression ring or other retaining device. Alternatively, the shank of the cutting pick can extend past the rearward end to accommodate a rearward shank retaining device, such as an external clip. Combinations of retaining devices and methods can be used. An example cutting pick 82 is visible in FIG. 6, where the carbide tip 84 on a front end and a shoulder 86 are shown.

Figure 6:
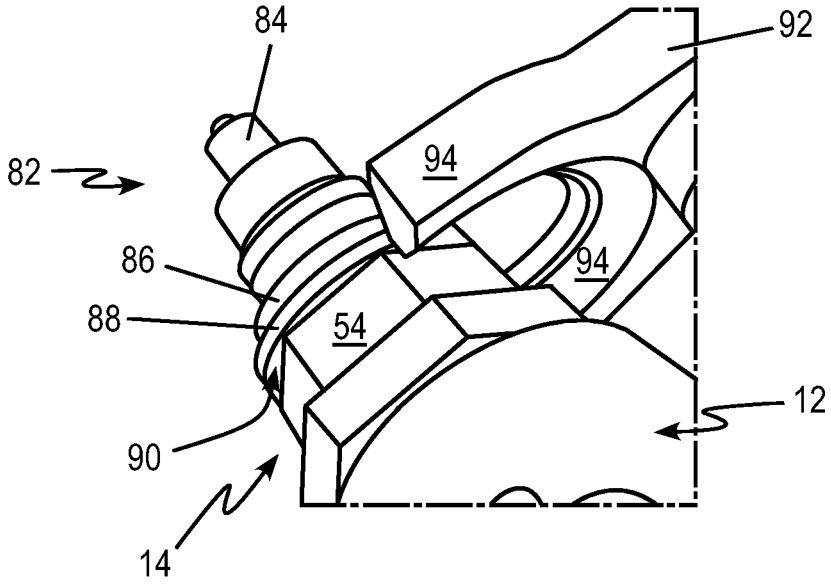
FIG. 6 shows an isometric view of an optional auxiliary function of the hollow sleeve where a removal tool can be used to facilitate removal of a cutting pick from a block and sleeve assembly.

The polygonal shape of the head portion 54 of the hollow sleeve 14 can have an optional auxiliary function as illustrated in FIG. 6. The polygonal shape can optionally be inscribed within the shoulder 86 of the cutting pick 82, or a washer 88 intermediate between the hollow sleeve 14 and the cutting pick 82. When so arranged, the rearward surface of the shoulder 86 or washer 88, if present, is exposed. Optionally, one or more of the edges of the shoulder 86 or one or more areas of the washer 88, if present, extends radially further than the outer peripheral edges 78 of the head portion 54 of the hollow sleeve 14 to expose a rearward surface of the shoulder 86 or washer 88. In FIG. 6, a washer 88 is present, so the exposed surface is the rearward surface 90 of the washer 88. A removal tool, such as a forked lever 92, can be placed in contact with the exposed rearward surface 90. The separation distance between prongs 94 of the forked lever 92 is greater than the diameter of opposing faces of the head portion 54, but less than the diameter or radial position of the circumference of the rearward surface 90 of the shoulder 86 or of the washer 88, if present, so that the prongs 94 can be slipped beside the head portion 54 but still levered to facilitate removal of the cutting pick 82. This auxiliary feature is advantageous when the cutting pick 82 is lacking a puller groove or the puller groove is worn away.

Although described in connection with preferred embodiments thereof, it will be appreciated by those skilled in the art that additions, deletions, modifications, and substitutions not specifically described may be made without department from the spirit and scope of the invention as defined in the appended claims.

The disclosures in U.S. provisional patent application No. 61/053,268, from which this application claims priority, are incorporated herein by reference.

What is claimed is:

1. A block and sleeve assembly, comprising:

a holder block; and a hollow sleeve, wherein the hollow sleeve includes a body including a shank portion, a head portion, and a shoulder portion, and a central bore extending axially and rearwardly from an opening in a forwardmost surface of the head portion, the central bore to receive a shank of a cutting pick, wherein the shank portion, head portion and shoulder portion are arranged longitudinal along a central axis with the shoulder portion separating the shank portion from the head portion, and wherein, in radial cross-section, outer peripheral edges of the shoulder portion have a shape of a first polygon, wherein the holder block comprises a base portion and a body portion, the body portion including an opening extending longitudinally from a front face to receive the shank portion of the hollow sleeve, and wherein the front face includes a stop projecting forwardly past a plane of the front face, the stop positioned radially offset from a circumference of the opening to allow a rearward surface of the shoulder portion of the hollow sleeve to contact the front face of the holder block and to prevent rotation of the hollow sleeve greater than N degrees, $$N = \frac{360}{n},$$

where n is the number of sides of the first polygon.

2. The block and sleeve assembly of claim 1, wherein the outer peripheral edges of the shoulder portion have a thickness, wherein the thickness of each outer peripheral edge defines a face having a shape of a second polygon, and wherein the face of one outer peripheral edge contacts the stop.

3. The block and sleeve assembly of claim 2, wherein outer peripheral edges of the head portion have a plurality of faces joined at a corner, each face having a shape of a third polygon.

4. The block and sleeve assembly of claim 3, wherein the outer peripheral edges of the head portion are radially inward from the outer peripheral edges of the shoulder portion.

5. The block and sleeve assembly of claim 3, wherein the second polygon and third polygon are joined together in the axial direction by another polygonal surface to form a faceted side of the sleeve, and wherein the sleeve has a plurality of faceted sides about its circumference.

6. A machine for mining, excavating, tunneling, road planing and/or construction, comprising:

a rotatable element; and the block and sleeve assembly as in claim 1 mounted on the rotatable element.

7. An assembly, comprising:

a holder block;

a hollow sleeve; and a cutting pick, wherein the hollow sleeve includes a body including a shank portion, a head portion, and a shoulder portion, and a central bore extending axially and rearwardly from an opening in a forwardmost surface of the head portion, wherein the shank portion, head portion and shoulder portion are arranged longitudinal along a central axis with the shoulder portion separating the shank portion from the head portion, wherein, in radial cross-section, outer peripheral edges of the shoulder portion have a shape of a first polygon, wherein the holder block comprises a base portion and a body portion, the body portion including an opening extending longitudinally from a front face to receive the shank portion of the hollow sleeve, wherein the front face includes a stop projecting forwardly past a plane of the front face, the stop positioned radially offset from the opening to allow a rearward surface of the shoulder portion of the hollow sleeve to contact the front face of the holder block and to prevent rotation of the hollow sleeve greater than N degrees, $$N = \frac{360}{n},$$

where n is the number of sides of the first polygon, and wherein a shank of the cutting pick is inserted into the central bore of the hollow sleeve.

8. The assembly of claim 7, wherein the outer peripheral edges of the shoulder portion have a thickness, wherein the thickness of each outer peripheral edge defines a face having a shape of a second polygon, and wherein the face of one outer peripheral edge contacts the stop.

9. The assembly of claim 8, wherein outer peripheral edges of the head portion have a plurality of faces joined at a corner, each face having a shape of a third polygon.

10. The assembly of claim 9, wherein the outer peripheral edges of the head portion are radially inward from the outer peripheral edges of the shoulder portion.

11. The assembly claim 9, wherein a rearward facing surface of a shoulder of the cutting pick extends radially further than the outer peripheral edges of the head portion of the hollow sleeve.

12. The assembly of claim 9, wherein the second polygon and third polygon are joined together in the axial direction by another polygonal surface to form a faceted side of the sleeve, and wherein the sleeve has a plurality of faceted sides about its circumference.

13. The assembly of claim 7, comprising a washer intermediate between the hollow sleeve and the cutting pick, wherein the washer extends radially further than outer peripheral edges of the head portion of the hollow sleeve to expose a rearward surface of the washer.

14. A hollow sleeve adapted to be mounted in a holder block and to receive a shank of a cutting pick, the hollow sleeve comprising:

a shank portion;

a head portion; and a shoulder portion, wherein the shank portion, head portion and shoulder portion are arranged longitudinal along a central axis with the shoulder portion separating the shank portion from the head portion, wherein a central bore extends axially and rearwardly from an opening in a forwardmost surface of the head portion, wherein, in radial cross-section, outer peripheral edges of the shoulder portion have a shape of a first polygon.

15. The hollow sleeve of claim 14, wherein the outer peripheral edges of the shoulder portion have a thickness, wherein the thickness of each outer peripheral edge defines a face having a shape of a second polygon, and wherein the outer peripheral edges of the head portion include a plurality of faces joined at a corner, each face having a shape of a third polygon.

16. The hollow sleeve of claim 15, wherein the outer peripheral edges of the head portion are radially inward from the outer peripheral edges of the shoulder portion.

17. The hollow sleeve of claim 16, wherein the shape of the first polygon is different from the shape of the third polygon.

18. The hollow sleeve of claim 15, wherein the shape of the first polygon is different from the shape of the third polygon.

19. The hollow sleeve of claim 15, wherein the second polygon and third polygon are joined together in the axial direction by another polygonal surface to form a faceted side of the sleeve, and wherein the sleeve has a plurality of faceted sides about its circumference.

* * * * *